US011401692B2

(12) United States Patent
Rannow et al.

(10) Patent No.: US 11,401,692 B2
(45) Date of Patent: Aug. 2, 2022

(54) INTELLIGENT RIDE CONTROL

(71) Applicant: Danfoss Power Solutions II Technology A/S, Nordborg (DK)

(72) Inventors: Michael Berne Rannow, Eden Prairie, MN (US); Meng Wang, Chanhassen, MN (US)

(73) Assignee: Danfoss Power Solutions II Technology A/S, Nordborg (DK)

( * ) Notice: Subject to any disclaimer, the term of this patent is extended or adjusted under 35 U.S.C. 154(b) by 186 days.

(21) Appl. No.: 16/631,060

(22) PCT Filed: Jul. 12, 2018

(86) PCT No.: PCT/US2018/041866
§ 371 (c)(1),
(2) Date: Jan. 14, 2020

(87) PCT Pub. No.: WO2019/014472
PCT Pub. Date: Jan. 17, 2019

(65) Prior Publication Data

US 2020/0149249 A1 May 14, 2020

Related U.S. Application Data

(60) Provisional application No. 62/532,774, filed on Jul. 14, 2017.

(51) Int. Cl.
*E02F 9/22* (2006.01)

(52) U.S. Cl.
CPC ..... *E02F 9/2207* (2013.01); *E02F 9/2221* (2013.01); *F15B 2211/6313* (2013.01); *F15B 2211/8613* (2013.01)

(58) Field of Classification Search
CPC ..... E02F 9/2207; E02F 9/2221; E02F 3/432; F15B 2211/6313; F15B 2211/8613
See application file for complete search history.

(56) References Cited

U.S. PATENT DOCUMENTS 7,165,395 B2 * 1/2007 Anderson ..... E02F 9/2207 60/413
7,194,856 B2 * 3/2007 Ma ..... E02F 9/2207 60/418

(Continued)

FOREIGN PATENT DOCUMENTS

GB 2445165 * 12/2006 ..... E02F 9/22
GB 2 445 165 A 7/2008
KR 10-2013-0055302 A 5/2013

OTHER PUBLICATIONS

International Search Report and Written Opinion of the International Searching Authority for International Patent Application No. PCT/US2018/041866 dated Nov. 27, 2018, 9 pages.

(Continued)

*Primary Examiner* — Dustin T Nguyen
(74) *Attorney, Agent, or Firm* — Merchant & Gould P.C.

(57) ABSTRACT

A hydraulic system includes a hydraulic mechanism that includes a first and a second chamber. The hydraulic system includes a control valve fluidly connected to the first chamber and a pressure sensor that is configured to measure the fluid pressure in the first chamber. The hydraulic system includes a processing unit connected to the control valve. The processing unit is configured to control a hydraulic fluid flow rate to and from the first chamber of the hydraulic mechanism via the control valve to provide a shock absorption response. The hydraulic fluid flow rate is based at least in part on a pressure measurement received from the pressure sensor. The shock absorption response is based on a simulated hydraulic accumulator.

22 Claims, 4 Drawing Sheets

(56) References Cited

U.S. PATENT DOCUMENTS

| | | | | |
|---|---|---|---|---|
| 7,278,262 | B2 * | 10/2007 | Moon | E02F 9/2207 60/426 |
| 8,657,083 | B2 * | 2/2014 | Vigholm | E02F 9/2296 188/266.1 |
| 9,187,880 | B2 * | 11/2015 | Tsuruga | E02F 9/2091 |
| 9,765,501 | B2 | 9/2017 | Wang et al. | |
| 10,323,384 | B2 * | 6/2019 | Murugesan | F15B 11/006 |
| 2007/0056277 | A1 | 3/2007 | Mizoguchi et al. | |
| 2014/0130487 | A1 | 5/2014 | Akiyama et al. | |
| 2016/0319516 | A1 | 11/2016 | Duppong et al. | |
| 2017/0114525 | A1 | 4/2017 | Rosa Neto | |
| 2017/0121942 | A1 | 5/2017 | Danzl et al. | |

OTHER PUBLICATIONS

Extended European Search Report for European Patent Application No. 18832449.5 dated Mar. 12, 2021, 8 pages.

* cited by examiner

INTELLIGENT RIDE CONTROL

CROSS-REFERENCE TO RELATED APPLICATION

This application is a National Stage Application of PCT/US2018/041866, filed on Jul. 12, 2018, which claims the benefit of U.S. Patent Application Ser. No. 62/532,774, filed on Jul. 14, 2017, the disclosures of which are incorporated herein by reference in their entireties. To the extent appropriate, a claim of priority is made to each of the above disclosed applications.

BACKGROUND

Heavy construction vehicles such as wheel loaders, tractors, backhoe loaders, cranes, etc. often utilize ride control systems to improve ride quality when traveling. Most of these vehicles include a boom, or cantilevered mass, that tends to bounce and cause the entire vehicle to oscillate, which harshens the ride when traveling over uneven ground.

Existing ride control systems utilize an accumulator in communication with the lift cylinder(s) of the boom of the heavy construction vehicle. The system is either manually triggered or automatically triggered when the vehicle travels above a predetermined speed. When the system is triggered, the head side of the lift cylinder(s) is put in open fluid communication with a charged accumulator. When the boom bounces as the vehicle travels, hydraulic fluid partially compresses the gas on the opposite side of an elastic diaphragm within the accumulator, allowing the boom to partially lower. On rebound, the pressurized gas in the accumulator exerts a force back on the hydraulic fluid and raises the boom back upward. This results in a cushioning effect and allows for a softer ride.

However, existing ride control systems must be disabled when using the boom in work operations (such as digging) due to the spongy nature of the response of the lift cylinder (s) when encountering a shock load. This is not a problem when the system is triggered by a predetermined speed. However, speed triggered systems are impossible to use independent of a speed threshold, thereby limiting the flexibility and use of the system. The system can only be toggled on and off and its behavior cannot be altered over time to react to changing conditions, this system is often referred to as "passive." Manual systems require the operator to remember to disable the system, and sometimes even leave the cab of the vehicle to disable such a system, which is inefficient. Further, accumulators add additional cost and safety concerns to the overall system.

Therefore, improvements in systems that cushion relatively high inertia loads are needed. Specifically, improvements in ride control systems are needed.

SUMMARY

The present disclosure relates generally to a dampening system that dampens relatively high inertia loads. In one possible configuration, and by non-limiting example, a hydraulic system that utilizes a single control valve per hydraulic port to toggle fluid to and from a hydraulic mechanism at a flow rate that is calculated based on a virtual accumulator is disclosed.

In one aspect of the present disclosure, a hydraulic system is disclosed. The hydraulic system includes a hydraulic mechanism that includes a first and a second chamber. The hydraulic system includes a control valve fluidly connected to the first chamber and a pressure sensor that is configured to measure the fluid pressure in the first chamber. The hydraulic system includes a processing unit connected to the control valve. The processing unit is configured to control a hydraulic fluid flow rate to and from the first chamber of the hydraulic mechanism via the control valve to provide a shock absorption response. The hydraulic fluid flow rate is based at least in part on a pressure measurement received from the pressure sensor. The shock absorption response is based on a simulated hydraulic accumulator.

In another aspect of the present disclosure, a method of damping the movement of a hydraulic mechanism in a hydraulic system where the hydraulic mechanism includes a first chamber and a second chamber is disclosed. The method includes sensing a load pressure of the first chamber of the hydraulic mechanism and setting a virtual accumulator pressure. The method includes calculating a hydraulic fluid flow rate based at least partially on the difference between the load pressure and the virtual accumulator pressure. The method includes adjusting a control valve to toggle the calculated flow rate of hydraulic fluid to or from the first chamber to provide a shock absorption response.

In still another aspect of present disclosure, a hydraulic system is disclosed. The hydraulic system includes a hydraulic mechanism that includes a plurality of chambers where each chamber corresponds with a port. The hydraulic system includes a plurality of control valves where each valve is fluidly connected to a singular port. The hydraulic system includes a plurality of pressure sensors that are configured to measure the fluid pressure in each of the plurality of chambers of the hydraulic mechanism. The hydraulic system includes a processing unit connected to the plurality of control valves. The processing unit is configured to control a hydraulic fluid flow rate to and from each port via the plurality of control valves to provide a shock absorption response. The hydraulic fluid flow rate to and from each port is based at least in part on a pressure measurement received from each pressure sensor. The shock absorption response is based on a simulated hydraulic accumulator.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
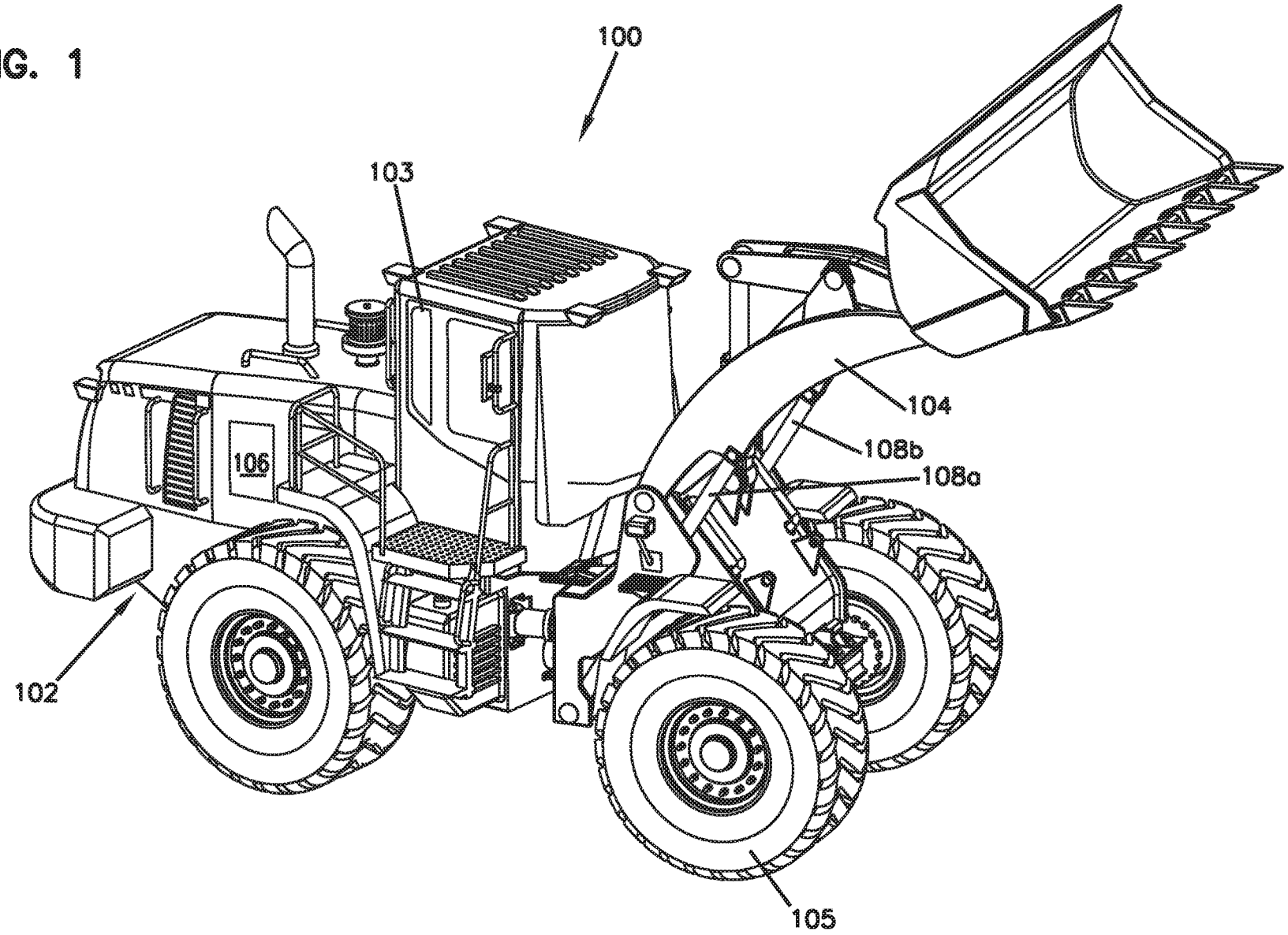
FIG. 1 illustrates a perspective view of an example machine, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The system disclosed herein has several advantages. The system removes the need for an accumulator in a ride control system and selectively toggles fluid to and from a hydraulic mechanism to provide a shock absorption effect. This has both cost saving and safety advantages. Further, in some examples, the system disclosed herein is configured to be independently operable of a speed threshold of the vehicle, allowing the user to alter the behavior the system no matter what the speed of the vehicle, thereby adding the flexibility to use the system at will. In other examples, the system can be speed dependent and thereby alter its behavior dependent on the speed of the vehicle. Also, the system can be customized easily to adapt to different machines or conditions without needing to change hardware.

A machine 100 is shown in FIG. 1. In the depicted example, the machine 100 is a wheel loader. The machine 100 includes a main frame 102, a cab 103, a boom 104, and a set of wheels 105. The machine 100 is configured to be controlled from the cab 103 by an operator and travel over a surface via the wheels 105. The machine 100 further includes a ride control system 106 that is configured to provide a shock absorption response to the boom 104.

The boom 104 is pivotally attached to the machine 100 and can be raised and lowered about the main frame 102 by a pair of lift actuators 108*a*, 108*b*. In some examples, the machine 100 only includes a single lift actuator to raise and lower the boom 104. In some examples, the boom 104 includes a bucket 110 that is configured to haul a load.

The lift actuators 108*a*, 108*b* can be hydraulic actuators that are operable to extend and contract, thereby causing the boom to raise and lower. As shown in the ride control system schematic diagram of FIG. 2, each hydraulic actuator 108*a*, 108*b* has a cylinder 112 and a piston 114 located within the cylinder 112. The piston 114 slides within the cylinder 112 and, with the cylinder 112, defines a plurality of chambers 116 for receiving pressurized hydraulic fluid. A rod 118 attached to the piston 114 extends through one of the chambers 116, through a wall of the cylinder 112, and is connected to the boom 104 to exert forces on and cause movement thereof.

Figure 2:
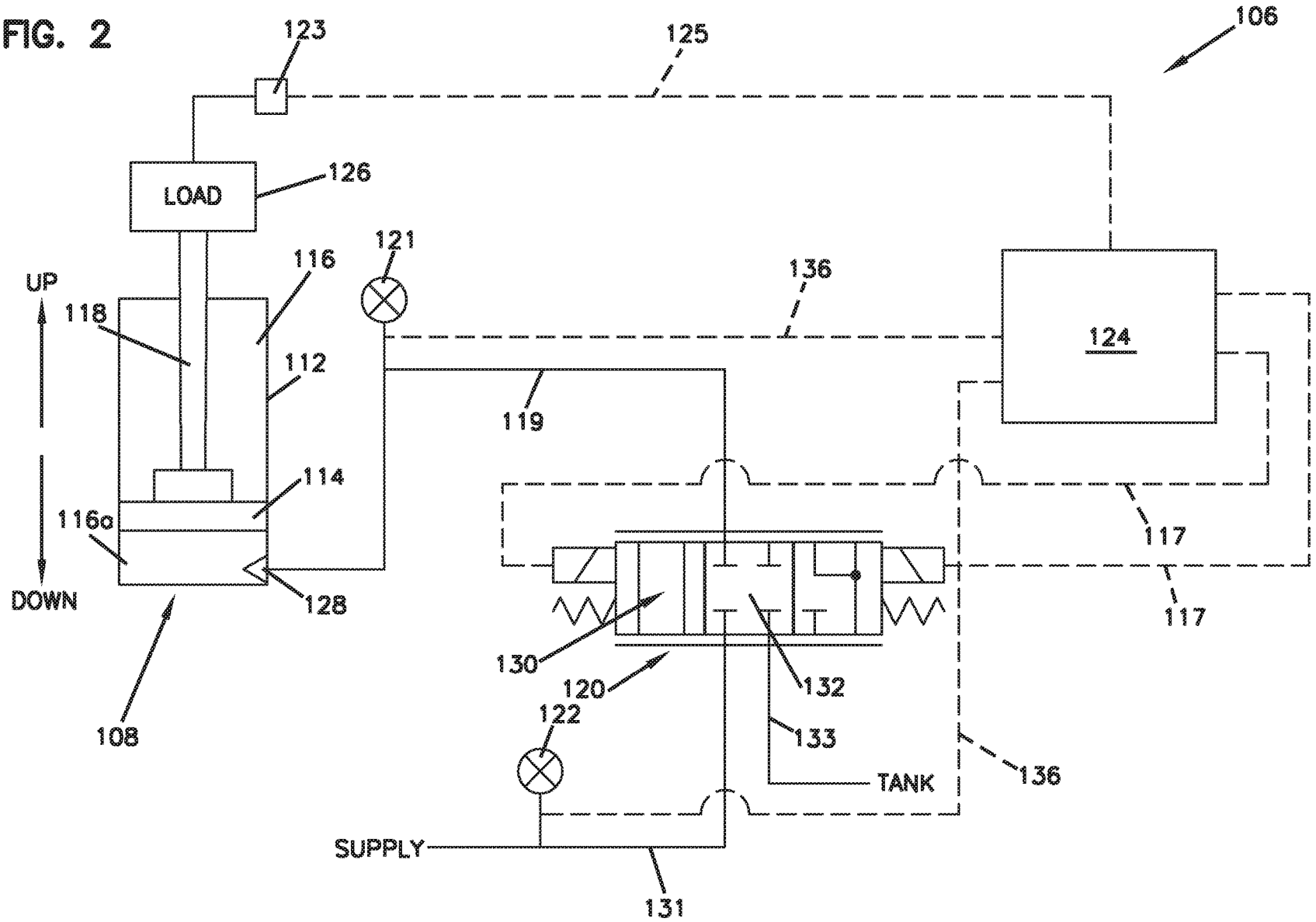
FIG. 2 illustrates a schematic view of the ride control system of the machine of FIG. 1.

With continued reference to FIG. 2, a first chamber 116*a* (also sometimes referred to herein as the "load holding chamber 116*a*") of the plurality of chambers 116 is located on the head side of the actuator's piston 114, on the opposite side of the actuator's rod 118. The second chamber 116*b* (also sometimes referred to herein as the "non-load holding chamber 116*b*") of the plurality of chambers 116 is located on the rod side of the cylinder 112.

It should be noted that while the ride control system 106 (sometimes referred to herein as the "system 106") is illustrated and described herein with reference to a machine 100 comprising a wheel loader having a boom 104, the ride control system 106 may be applied to and used in connection with any machine 100 having a boom, cantilevered mass, elongate members, or other high inertia components where there is an advantage to provide a shock absorption response thereto. Additionally, as used herein, the term "hydraulic system" means and includes any system commonly referred to as a hydraulic or pneumatic system, while the term "hydraulic fluid" means and includes any incompressible or compressible fluid that may be used as a working fluid in such a hydraulic or pneumatic system.

In the depicted example of the ride control system 106 shown in FIG. 2, the system 106 includes the actuator 108, a control valve 120, a pair of pressure sensors 121, 122 and a processing unit 124. The system 106 is configured to toggle hydraulic fluid flow to and from the first chamber 116*a*, the load holding chamber, to provide shock absorption response to the actuator 108.

The actuator 108 is shown to be schematically supporting a generic load 126 via the rod 118. Specifically, as mentioned above, the first chamber 116*a* is shown to be the load holding chamber. The generic load 126 can represent any load that has mass. For example, the load 126 can be the boom 104 and/or the boom 104 including an implement (e.g., a bucket).

During a force exerted downward (load direction is indicated by an arrow in FIG. 2) by the load 126, for example caused by a bump in the road, if hydraulic fluid is locked within the chamber 116*a*, slight compression of the hydraulic fluid contained with the first chamber 116*a* occurs. Once the hydraulic fluid is compressed, the force downward is transferred from the fluid to the cylinder 112 and to an element (i.e., machine 100) to which the cylinder 112 is attached. If fluid were to be allowed to escape the first chamber 116*a* during a force exerted downward by the load 126, the piston 114 would either bottom out at the base of the cylinder 112, or enough fluid would be forced out of the first chamber 116*a* to drop the position of the load 126. Both of these scenarios are not favorable.

Shock loads transferred from the actuator 108 to the machine 100 while the machine is moving are undesirable for ride quality. To counteract this, the control valve 120 and the processing unit 124 are configured to provide a shock absorption response to cushion such loads from being transferred to the main frame 102 of the machine 100. This is accomplished by simulating an accumulator by toggling fluid to and from the first chamber 116*a* via the control valve 120.

It should be noted that while the ride control system 106 is illustrated and described herein including control logic that simulates an accumulator, the ride control system 106 might include control logic that simulates other types of damping mechanisms. Generically, the ride control system 106 can include control logic that simulates a force generator that is capable of providing a shock absorption response.

The control valve 120 is connected and controllable via the processing unit 124 by communication links 117 (either wired or wireless). While only a single control valve 120 is shown, the machine 100 can include a plurality of control valves to perform shock absorption responses. Depending on the hydraulic mechanism, a single control valve 120 can be used per hydraulic port 128 for controlling an individual chamber. For example, in the machine 100 shown in FIG. 1, a pair of control valves 120 can be utilized to control the shock absorption response for actuators 108*a*, 108*b*. In such an embodiment, a single processing unit 124 can still be used to control the operation of multiple control valves 120. In the example depicted in FIG. 2, a single control valve 120 is connected to port 128 which places the control valve 120 in fluid communication with the first chamber 116*a* via a control valve line 119.

According to the example embodiment shown in FIG. 2, the control valve 120 comprises a solenoid-actuated, metering valve being operable in three positions. It should be appreciated and understood, however, that in other example embodiments, the control valves 120 may comprise other types of valves having similar capabilities and functionality. In the example shown, the control valve 120 can be moved to a first position 130, in which hydraulic fluid can be supplied to the first chamber 116*a* via a fluid supply line 131. The fluid supply line 131 can be connected to a flow control source (e.g., a pump). When moved to a second position 132, the control valve 120 is fully closed. This closed position can be utilized when operating the actuator 108 in a work operation, such as a digging operation. When moved to a third position 134, the control valve 120 allows fluid from the first chamber 116*a* to drain to a hydraulic fluid tank via a drain line 133.

While the system 106 is described herein with the control valve 120 comprising a solenoid-actuated, metering control valve having three positions, it should, however, be appreciated and understood that control valves 120 may comprise other forms of control valves 120 in other example embodiments that are operable to simultaneously and independently provide fluid flow in response to receiving control signals from processing unit 124. It should also be appreciated and understood that control valves 120 may comprise respective embedded controllers that are operable to communicate with processing unit 124 and to operate with processing unit 124 in achieving the functionality described herein.

The system 106 also can include a plurality pressure sensors 121, 122. In some examples, the system 106 only includes the first pressure sensor 121. The first pressure sensor 121 is configured to sense the load pressure ($P_{load}$) in the first chamber 116*a*. Optionally, the second sensor 122 is configured to sense the pressure in the supply line 131. The pressure sensors 121, 122 are operable to produce and output an electrical signal or data representative of the measured hydraulic fluid pressures. The pressure sensors 121, 122 are connected to processing unit 124 via communication links 136 for the communication of signals or data corresponding to the measured hydraulic fluid pressures. Communication links 136 may communicate the signals or data representative of the measured hydraulic fluid pressures to the processing unit 124 using wired or wireless communication components and methods.

The system 106 can also optionally include a position sensor 123 that is fixedly mounted to load 126 (e.g., boom 104) to measure the position of the load 126 over time. In some examples, the position sensor 123 is a linear position sensor. In other examples, the position sensor 123 is an angular position sensor. The position sensor 123 is connected to processing unit 124 via communication links 125 for the communication of signals or data corresponding to the position of the load 126. Communication links 125 may, in accordance with an example embodiment, comprise structure and utilize methods for communicating such output signals or data via wired and/or wireless technology.

The processing unit 124 is operable to execute a plurality of software instructions that, when executed by the processing unit 124, cause the system 106 to implement the system's methods and otherwise operate and have functionality as described herein. The processing unit 124 may comprise a device commonly referred to as a microprocessor, central processing unit (CPU), digital signal processor (DSP), or other similar device and may be embodied as a stand-alone unit or as a device shared with components of the hydraulic system with which the system 106 is employed. The processing unit 124 may include memory for storing the software instructions or the system 106 may further comprise a separate memory device for storing the software instructions that is electrically connected to the processing unit 124 for the bi-directional communication of the instructions, data, and signals therebetween.

According to an example embodiment, the control valve 120 and processing unit 124 are co-located in a single, integral unit. However, it should be appreciated and understood that, in other example embodiments, the control valves 120 and processing unit 124 may be located in multiple units and in different locations. In one example, at least one control valve 120 and at least one pressure sensor 121 are required per hydraulic port for controlling individual hydraulic chambers.

Figure 3:
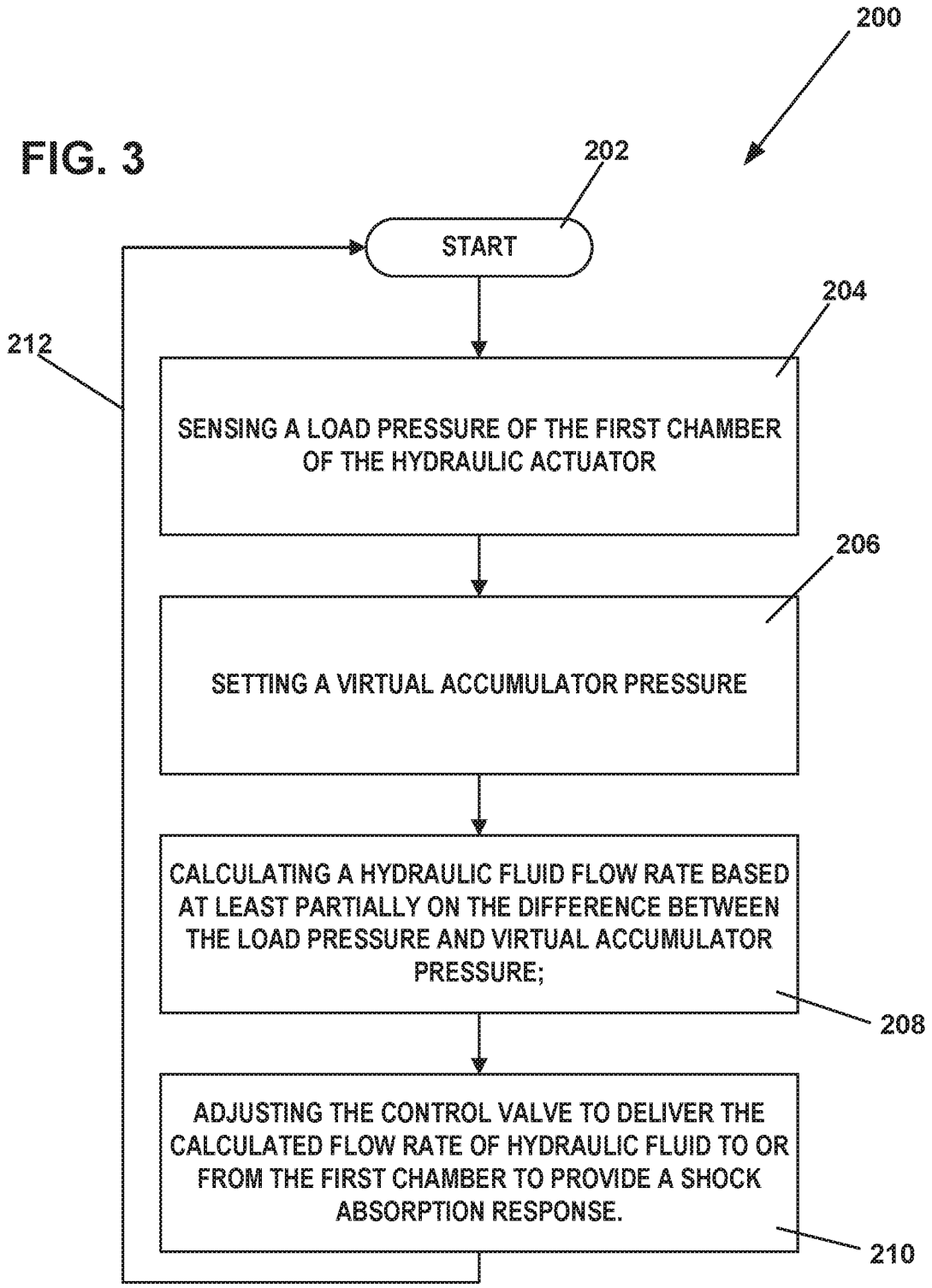
FIG. 3 illustrates a flowchart representation of a method for providing a shock absorption response, according to one embodiment of the present disclosure.

The system 106 operates in accordance with a method 200 illustrated in FIG. 3 to provide a shock absorption response. Operation, according to method 200, starts at step 202 and proceeds to step 204 where the load pressure ($P_{load}$) of the first chamber 116*a* is sensed via pressure sensor 121. Next, at step 206, the processing unit 124 sets a virtual accumulator pressure ($P_{acc}$). The virtual accumulator pressure ($P_{acc}$) can be a pressure value based on a preset value of a simulated accumulator. In some examples, the virtual accumulator pressure ($P_{acc}$) can be set based on a preset operation mode. In other examples, the virtual accumulator pressure ($P_{acc}$) can be set based on a preset range of values that correspond to a measured load pressure ($P_{load}$). In other examples, the virtual accumulator pressure ($P_{acc}$) can initially be set to be equal to the load pressure ($P_{load}$). In other examples still, the virtual accumulator pressure ($P_{acc}$) is equal to the load pressure ($P_{load}$) plus a predetermined boost value.

Continuing with step 208, the processing unit 124 calculates the hydraulic flow rate ($Q_{valve}$) that must either exit or enter the first chamber 116*a* in order to simulate the virtual accumulator. The processing unit 124 calculates this hydraulic flow rate ($Q_{valve}$) at least partially based on the difference between the load pressure ($P_{load}$) and the virtual accumulator pressure ($P_{acc}$). Subsequently, at step 210, the processing unit 124 adjusts the control valve 120 to one of the three positions 130, 132, 134 depending on the calculated hydraulic flow rate ($Q_{valve}$). If the hydraulic flow rate ($Q_{valve}$) dictates that fluid be removed from the first chamber 116*a* to provide a shock absorption response, the processing unit 124 commands the control valve 120 to move to the third position 134. Alternatively, if the if the hydraulic flow rate ($Q_{valve}$) dictates that fluid be added to the first chamber 116*a* to provide a shock absorption response, the processing unit 124 commands the control valve 120 to move to the first position 130. Further, if no shock absorption response is deemed required, the control valve 120 will be positioned in the second position 132.

The method 200 is configured to be performed at an individual time step. As indicated in FIG. 3 by arrow 212, the method 200 is repeated at each time step to provide an active shock absorption response that adapts to changing conditions.

Figure 4:
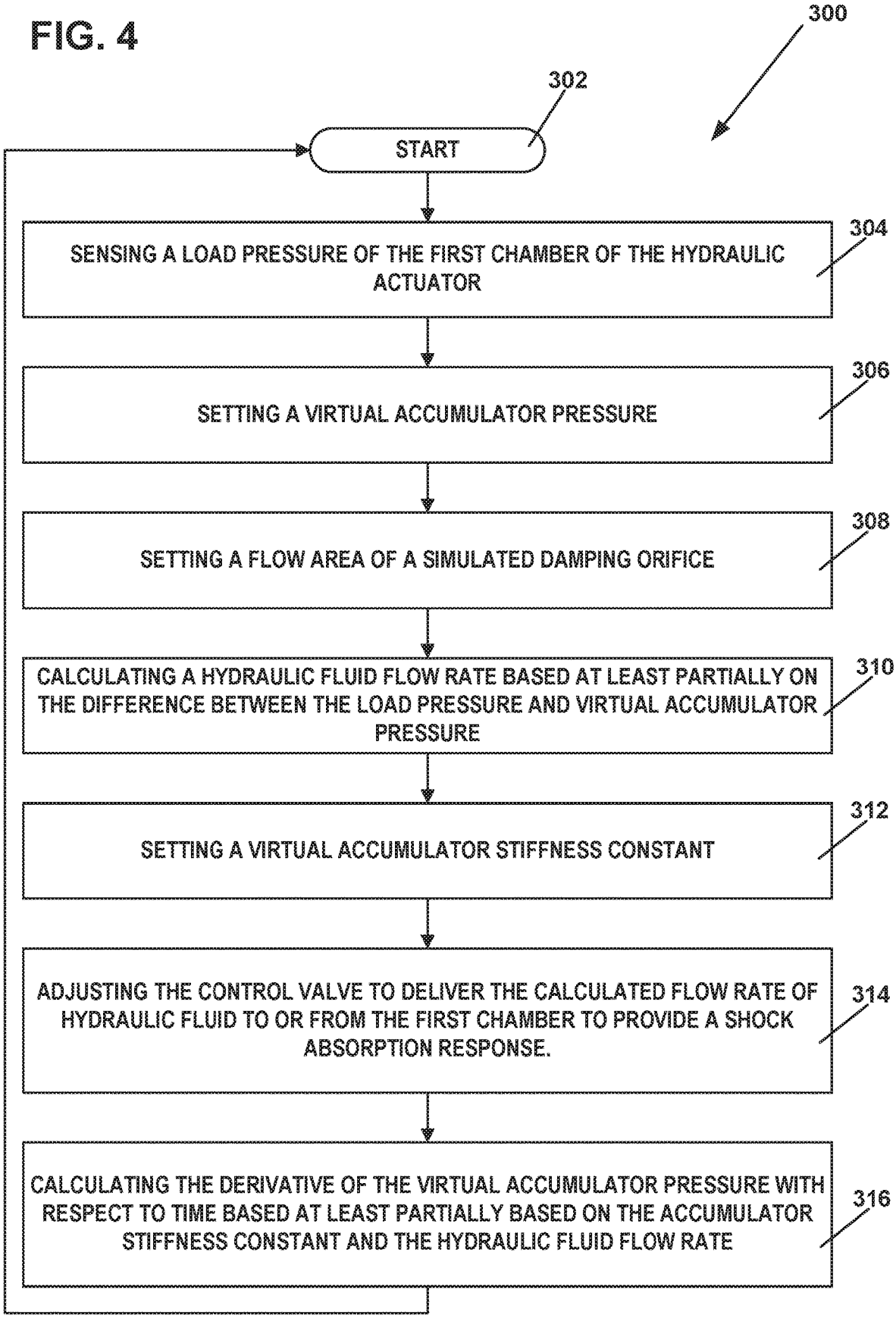
FIG. 4 illustrates a flowchart representation of another method for providing a shock absorption response, according to one embodiment of the present disclosure.

The system 106 also operates in accordance with a method 300 illustrated in FIG. 4 to provide a shock absorption response. Operation, according to method 300, starts at step 302 and proceeds to step 304 where the load pressure ($P_{load}$) of the first chamber 116*a* is sensed via pressure sensor 121. Next, at step 306, the processing unit 124 sets a virtual accumulator pressure ($P_{acc}$). As discussed with respect to step 206 of method 200, the virtual accumulator pressure ($P_{acc}$) can be a variety of different preset values, be initially set to be equal to the load pressure ($P_{load}$), or equal to the load pressure load ($P_{load}$) plus a predetermined boost value.

Next at step 308, the processing unit sets a flow area (k) of a simulated damping orifice. In some examples, this flow area can be time varied by which the processing unit alters the flow area (k) value at different time steps. In some examples, the flow area (k) of the simulated orifice can be selected from a range of predetermined values based on input provided to the processing unit 124 (e.g., the operator input). For example, depending on the shock absorption response that is desired (i.e., stiff or soft) the flow area (k) can be varied. For example, decreasing the value of the flow area (k) can result in stiffer shock absorption response.

Continuing with step 310, the processing unit 124 calculates the hydraulic flow rate ($Q_{valve}$) that must either exit or enter the first chamber 116*a* in order to simulate the virtual accumulator. The processing unit 124 calculates this hydraulic flow rate ($Q_{valve}$) at least partially based on the difference between the load pressure ($P_{load}$) and virtual accumulator pressure ($P_{acc}$). Further, in some examples, the flow rate ($Q_{valve}$) is given by:

$$Q_{valve}=k(|P_{load}-P_{acc}|)\sin(P_{load}-P_{acc})$$

Next, at step 312, the processing unit 124 sets a virtual accumulator stiffness constant ($S(\tilde{P})$). The virtual accumulator stiffness constant ($S(\tilde{P})$) dictates how the virtual accumulator will behave to changes in load pressure ($P_{load}$) over time. In some examples, like the flow area (k), the virtual accumulator stiffness constant ($S(\tilde{P})$) can be tunable. For example, the operator can alter accumulator stiffness constant ($S(\tilde{P})$) to change the shock adsorption response of the system 106.

At step 314, like at step 210 of method 200, the processing unit 124 adjusts the control valve 120 to one of the three positions 130, 132, 134 depending on the calculated hydraulic fluid flow rate ($Q_{valve}$).

At step 316, the processing unit 124 calculates the virtual accumulator pressure derivative ($\dot{P}_{acc}$) with respect to time. The virtual accumulator pressure derivative ($\dot{P}_{acc}$) is at least partially based on the accumulator stiffness constant ($S(\tilde{P})$) and the hydraulic flow rate ($Q_{valve}$). In some examples, the virtual accumulator pressure derivative ($\dot{P}_{acc}$) is given by:

$$\dot{P}_{acc}=S(\tilde{P})Q_{valve}$$

Because the virtual accumulator pressure derivative ($\dot{P}_{acc}$) is based on time, the virtual accumulator pressure derivative ($\dot{P}_{acc}$) can be used to solve for the virtual accumulator pressure ($P_{acc}$) at each time step, thereby allowing the processing unit 124 to track the virtual accumulator pressure ($P_{acc}$) at each time step as fluid flow is added to, and removed from, the first chamber 116*a*. In some examples, this allows the processing unit 124 to use a new adapted value of the virtual accumulator pressure ($P_{acc}$) at each time step, thereby simulating a shock adsorption response of an accumulator.

As with method 200, method 300 is configured to be performed at an individual time step. As indicated in FIG. 4 by arrow 318, the method 300 is repeated at each time step to provide an active shock absorption response that adapts to changing conditions. Further, the method 300 provides for an actively changing virtual accumulator pressure ($P_{acc}$) based on the accumulator stiffness constant ($S(\tilde{P})$) and the hydraulic flow rate ($Q_{valve}$), with respect to time. This produces a realistic shock absorption response that simulates an accumulator in the system 106.

In some examples, the processing unit 124 can also compensate for drift of the actuator 108 over time. This compensation can be accomplished by using a measurement from the position sensor 123 attached to the load 126. The measurement can be used by the processing unit 124 to adjust the hydraulic fluid flow rate ($Q_{valve}$). Further, in some examples, the flow rate ($Q_{valve}$) when compensating for actuator drift, is given by:

$$Q_{valve}=k(|P_{load}-P_{acc}|)\sin(P_{load}-P_{acc})+f(x_{desired}-x_{load})$$

where: $x_{desired}$ is a preset ideal value for the position of the load;

$x_{load}$ is the measured position of the load; and f is a gain value term such as an integer, function, or dampening term.

In some examples, drift compensation will not be required. In other examples, the operator can manually account for drift over time by manually adjusting the position of the load 126. This manual adjusting may be applicable where drift occurs at a very slow rate over time.

As the system 106 operates, the control valve 120 and processing unit 124 work together to soften the impact of the load 126 on the machine during a traveling motion. Typically, this would include providing multiple shock absorption responses at multiple time steps in which the control valve allows fluid to flow out of, and into, the first chamber 116*a* multiple times, the magnitude of which is determined by the pressure sensor 121 and the processing unit 124.

The system 106 described herein can also be independently operable of any speed threshold of the machine 100. This allows the shock absorption response produced by the system 106 to be altered to fit a specific need of the machine 100. In some examples, the shock absorption response can be altered depending on the particular speed of the machine 100. For example, the shock absorption response can produce stiffer damping the slower the machine 100 travels. This allows for a scenario where the system 106 can adequately perform a work operation (i.e., a digging action) at no or little speed even when the system 106 is active. Because the shock absorption response produced by the system 106 stiffens the slower the machine 100 travels, the shock absorption response when the machine 100 is not moving can be equal to, or almost equal to, no shock absorption response, thereby configuring all system connected actuators to react in a stiff manner that is preferred during a work operation. Then, as the machine's speed is increased, the shock absorbing response produced by the system 106 is adjusted so that the response becomes less stiff and increasingly cushions the ride of the machine 100 as the traveling speed is increased.

In other examples still, the system 106 can be tuned in real time as the vehicle is traveling, either dependent or independent of its speed. For example, the operator can switch between ride modes during operation, where each mode changes the shock absorption response of the system 106. This may be advantageous in extremely bumpy or unexpected terrain. Depending on the mode, the flow area (k) and/or accumulator stiffness constant ($S(\tilde{P})$) can be changed to change the overall characteristics of the virtual accumulator, thereby altering the behavior of the system 106.

EXAMPLES

Illustrative examples of the hydraulic system disclosed herein are provided below. An embodiment of the hydraulic system may include any one or more, and any combination of, the examples described below.

Example 1 is a hydraulic system that includes a hydraulic mechanism that includes a first and a second chamber. The hydraulic system includes a control valve fluidly connected to the first chamber and a pressure sensor that is configured to measure the fluid pressure in the first chamber. The hydraulic system includes a processing unit connected to the control valve. The processing unit is configured to control a hydraulic fluid flow rate to and from the first chamber of the hydraulic mechanism via the control valve to provide a shock absorption response. The hydraulic fluid flow rate is based at least in part on a pressure measurement received from the pressure sensor. The shock absorption response is based on a simulated hydraulic accumulator.

In Example 2, the subject matter of Example 1 is further configured such that the first chamber of the hydraulic mechanism is a load holding chamber and the second chamber is a non-load holding chamber.

In Example 3, the subject matter of Example 1 is further configured to include a position sensor configured to measure the position of the hydraulic mechanism.

In Example 4, the subject matter of Example 3 is further configured such that the processing unit uses the position of the hydraulic mechanism measured by the position sensor to at least partially control the hydraulic fluid flow rate to and from the first chamber of the hydraulic mechanism to compensate for drift of the hydraulic mechanism.

In Example 5, the subject matter of Example 1 is further configured such that the hydraulic fluid flow rate to and from the first chamber of the hydraulic mechanism is at least partially based on a flow area of a simulated damping orifice.

In Example 6, the subject matter of Example 1 is further configured such that the hydraulic fluid flow rate to and from the first chamber of the hydraulic mechanism is at least partially based on a virtual pressure of a virtual accumulator.

In Example 7, the subject matter of Example 6 is further configured such that the derivative of the virtual pressure of the virtual accumulator with respect to time is based on a tunable constant and the hydraulic fluid flow rate to and from the first chamber of the hydraulic mechanism.

In Example 8, the subject matter of Example 6 is further configured such that the hydraulic mechanism is a boom lift cylinder.

Example 9 is a method of damping the movement of a hydraulic mechanism in a hydraulic system where the hydraulic mechanism includes a first chamber and a second chamber. The method includes sensing a load pressure of the first chamber of the hydraulic mechanism and setting a virtual accumulator pressure. The method includes calculating a hydraulic fluid flow rate based at least partially on the difference between the load pressure and the virtual accumulator pressure. The method includes adjusting a control valve to toggle the calculated flow rate of hydraulic fluid to or from the first chamber to provide a shock absorption response.

In Example 10, the subject matter of Example 9 is further configured such that, initially, the virtual accumulator pressure is equal to the load pressure.

In Example 11, the subject matter of Example 9 is further configured such that, initially, the virtual accumulator pressure is equal to the load pressure plus a boost constant.

In Example 12, the subject matter of Example 9 is further configured such that, the hydraulic fluid flow rate is at least partially based on a flow area of a simulated damping orifice.

In Example 13, the subject matter of Example 12 is further configured such that, the flow area of the simulated damping orifice is varied based on time to produce a time varied shock absorption response.

In Example 14, the subject matter of Example 9 is further configured such that, further calculating the virtual accumulator pressure derivative with respect to time is based on the hydraulic fluid flow rate and a tunable constant.

In Example 15, the subject matter of Example 9 is further configured such that, the hydraulic fluid flow rate is at least partially based on a drift compensation factor.

In Example 16, the subject matter of Example 9 is further configured such that, the control valve is an electro-hydraulic flow control valve.

Example 17 is a hydraulic system including a hydraulic mechanism that includes a plurality of chambers where each chamber corresponds with a port. The hydraulic system includes a plurality of control valves where each valve is fluidly connected to a singular port. The hydraulic system includes a plurality of pressure sensors that are configured to measure the fluid pressure in each of the plurality of chambers of the hydraulic mechanism. The hydraulic system includes a processing unit connected to the plurality of control valves. The processing unit is configured to control a hydraulic fluid flow rate to and from each port via the plurality of control valves to provide a shock absorption response. The hydraulic fluid flow rate to and from each port is based at least in part on a pressure measurement received from each pressure sensor. The shock absorption response is based on a simulated hydraulic accumulator.

In Example 18, the subject matter of Example 17 further includes a position sensor configured to measure the position of the hydraulic mechanism.

In Example 19, the subject matter of Example 18 is further configured such that, the processing unit uses the position of the hydraulic mechanism measured by the position sensor to at least partially control hydraulic flow to and from the plurality of chambers of the hydraulic mechanism to compensate for drift.

In Example 20, the subject matter of Example 17 is further configured such that, hydraulic fluid flow rate to and from the plurality of chambers of the hydraulic mechanism is at least partially based on a flow area of a simulated damping orifice.

In Example 21, the subject matter of Example 17 is further configured such that, the hydraulic fluid flow rate to and from each port is at least partially based on a virtual pressure of a virtual accumulator.

In Example 22, the subject matter of Example 21 is further configured such that, the derivative of virtual pressure of the virtual accumulator with respect to time is based on a tunable constant and the hydraulic fluid flow rate to and from each port.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A hydraulic system comprising:

a hydraulic mechanism including a first chamber and a second chamber;

a control valve fluidly connected to the first chamber;

a pressure sensor configured to measure the fluid pressure in the first chamber of the hydraulic mechanism; and a processing unit connected to the control valve, the processing unit configured to control a hydraulic fluid flow rate to and from the first chamber of the hydraulic mechanism via the control valve to provide a shock absorption response, the hydraulic fluid flow rate being based at least in part on a pressure measurement received from the pressure sensor, wherein the hydraulic fluid flow rate is calculated by the processing unit based on a difference between the pressure measurement and a virtual pressure based on a simulated hydraulic accumulator.

2. The hydraulic system of claim 1, wherein the first chamber of the hydraulic mechanism is a load holding chamber and the second chamber is a non-load holding chamber.

3. The hydraulic system of claim 1, further comprising a position sensor configured to measure the position of the hydraulic mechanism.

4. The hydraulic system of claim 3, wherein the processing unit uses the position of the hydraulic mechanism measured by the position sensor to at least partially control the hydraulic fluid flow rate to and from the first chamber of the hydraulic mechanism to compensate for drift of the hydraulic mechanism.

5. The hydraulic system of claim 1, wherein the hydraulic fluid flow rate to and from the first chamber of the hydraulic mechanism is at least partially based on a flow area of a simulated damping orifice.

6. The hydraulic system of claim 1, wherein the hydraulic fluid flow rate to and from the first chamber of the hydraulic mechanism is at least partially based on the virtual pressure of the simulated hydraulic accumulator.

7. The hydraulic system 6, wherein a derivative of the virtual pressure of the simulated hydraulic accumulator with respect to time is based on a tunable constant and the hydraulic fluid flow rate to and from the first chamber of the hydraulic mechanism.

8. The hydraulic system 6, wherein the hydraulic mechanism is a boom lift cylinder.

9. A method of damping the movement of a hydraulic mechanism, the hydraulic mechanism including a first chamber and a second chamber, the method compromising:

sensing a load pressure of the first chamber of the hydraulic mechanism;

setting a virtual pressure based on a simulated hydraulic accumulator;

calculating a hydraulic fluid flow rate based at least partially on the difference between the sensed load pressure and the virtual pressure; and adjusting a control valve to toggle the calculated hydraulic fluid flow rate to or from the first chamber to provide a shock absorption response.

10. The method of claim 9, wherein, initially, the virtual pressure is equal to the load pressure.

11. The method of claim 9, wherein, initially, the virtual pressure is equal to the load pressure plus a boost constant.

12. The method of claim 9, wherein the hydraulic fluid flow rate is at least partially based on a flow area of a simulated damping orifice.

13. The method of claim 12, wherein the flow area of the simulated damping orifice is varied based on time to produce a time varied shock absorption response.

14. The method of claim 9, further calculating a virtual pressure derivative with respect to time based on the hydraulic fluid flow rate and a tunable constant.

15. The method of claim 9, wherein the hydraulic fluid flow rate is at least partially based on a drift compensation factor.

16. The method of claim 9, wherein the control valve is an electro-hydraulic flow control valve.

17. A hydraulic system comprising:

a hydraulic mechanism including a plurality of actuators, each of the actuators including a corresponding chamber port; a plurality of control valves, each of the plurality of control valves being fluidly connected to only one of the plurality of actuators at the corresponding chamber port a plurality of pressure sensors configured to measure the fluid pressure in each of the plurality of chambers of the hydraulic mechanism; and a processing unit connected to the plurality of control valves, the processing unit configured to control a hydraulic fluid flow rate to and from each port via the plurality of control valves to provide a shock absorption response, the hydraulic fluid flow rate to and from each port based at least in part on a pressure measurement received from each pressure sensor, wherein the hydraulic fluid flow rate is calculated by the processing unit based on a difference between the pressure measurement and a virtual pressure based on a simulated hydraulic accumulator.

18. The hydraulic system 17, further comprising a position sensor configured to measure the position of the hydraulic mechanism.

19. The hydraulic system 18, wherein the processing unit uses the position of the hydraulic mechanism measured by the position sensor to at least partially control hydraulic fluid flow to and from the plurality of chambers of the hydraulic mechanism to compensate for drift.

20. The hydraulic system 17, wherein the hydraulic fluid flow rate to and from the plurality of chambers of the hydraulic mechanism is at least partially based on a flow area of a simulated damping orifice.

21. The hydraulic system 17, wherein the hydraulic fluid flow rate to and from each port is at least partially based on the virtual pressure of the simulated hydraulic accumulator.

22. The hydraulic system 21, wherein a derivative of virtual pressure of the simulated hydraulic accumulator with respect to time is based on a tunable constant and the hydraulic fluid flow rate to and from each port.

* * * * *